United States Patent [19]

Saloff

[11] 4,370,768

[45] Feb. 1, 1983

[54] DAMPED FLUID DISPLACEMENT SUPPORT SYSTEM

[76] Inventor: William S. Saloff, Heather La., R.M., Gloversville, N.Y. 12078

[21] Appl. No.: 143,723

[22] Filed: Apr. 25, 1980

[51] Int. Cl.[3] ..... A47C 27/08

[52] U.S. Cl. ..... 5/450; 5/451; 5/455

[58] Field of Search ..... 5/450, 449, 451, 455

[56] References Cited

U.S. PATENT DOCUMENTS

| | | | |
|---|---|---|---|
| 2,748,399 | 6/1956 | Rockoff | 5/450 |
| 3,600,726 | 8/1971 | Williams | 5/450 |
| 3,611,455 | 10/1971 | Gottfried | 5/450 |
| 3,702,484 | 11/1972 | Tobinick | 5/348 WB |
| 3,789,442 | 2/1974 | Tobinick | 5/348 WB |
| 3,872,525 | 3/1975 | Lea et al. | 5/450 |
| 4,245,361 | 1/1981 | Evanson | 5/450 |

FOREIGN PATENT DOCUMENTS

| | | | |
|---|---|---|---|
| 608951 | 2/1979 | Switzerland | 5/455 |

*Primary Examiner*—Stephen J. Novosad
*Attorney, Agent, or Firm*—Heslin & Watts

[57] ABSTRACT

A liquid-sealed envelope contains a core of resilient urethane foam saturated with water, all air having been expelled therefrom. This assembly is enclosed within an outer casing of a resilient material to which the envelope is glued.

10 Claims, 3 Drawing Figures

DAMPED FLUID DISPLACEMENT SUPPORT SYSTEM

BACKGROUND AND SUMMARY OF THE INVENTION

This invention relates to support systems such as mattresses, cushions and the like, characterized by having a liquid within them, as, for example in waterbeds.

It is well-known that various benefits can be obtained by making waterbeds and other support systems having a liquid within them. Yet, these systems are subject to certain well-known shortcomings. First, conventional waterbeds and cushions produce a kind of wave action or rolling motion when in use due to the tendency of the water inside to rush rapidly from one part of the mattress to another. As a person places his weight on one portion of the support system, the water or other liquid is forced to flow to another part of the system. Since the envelope containing the liquid is typically elastically yieldable, there will be a reaction to the initial surge of liquid which will result in a succession of countersurges back and forth within the envelope until the system finds equilibrium. This undamped surging and countersurging of the liquid within mattresses is annoying to most people and actually produces motion sickness in some of them. To overcome this, many waterbed manufacturers do not use liquid displacement in that portion of the waterbed which is intended to support one's head and shoulders. Instead, they use a section of standard mattressing employing coil springs or equivalent nonliquid structures. Needless to say, this introduces an element of complexity to the manufacturing process. Other manufacturers have attempted to dampen waterbed wave motion in various ways. In U.S. Pat. No. 3,585,356, the use of solid particles, such as Styrofoam, are disposed in the liquid for this purpose. U.S. Pat. No. 3,736,604 uses flap means, as illustrated in FIG. 11 therein.

Another disadvantage associated with conventional liquid displacement support systems is that they are relatively unstable in the sense that they tend to react too quickly in response to the application or shifting of one's weight on them. If, for example, a person lying on a mattress attempts to roll over, he will find that the mattress yields rather quickly under him as he presses against it with one of his limbs to initiate movement. The bed sort of undulates under him as the water surges about within the mattress. Similarily, as one attempts to get out of bed, there is a feeling of instability since the mattress quickly gives way as his weight is shifted to its edge. This kind of instability is further illustrated when a water cushion is used on a conventional chair or on the seat of an automobile or a wheelchair. When used on a conventional chair, the instability is manifested most clearly as a person attempts to stand. The water is quickly displaced within the cushion as the person's weight is shifted and he has the feeling that the cushion is squirting out from under him as he attempts to thrust his body upwardly. The normal rocking motion of a moving automobile or wheelchair is greatly amplified by conventional water cushion systems for the same reasons.

Still another disadvantage associated with conventional liquid displacement support systems concerns the requirement that these systems be used for the most part in a horizontal disposition. The reason for this is that if a relatively elongated support unit is disposed vertically or at some considerable angle to the horizontal, the liquid will be drawn by gravity to the lower portions causing bulging in those areas while lowering or completely eliminating the cushioning and supportive effects in the upper areas. Thus, such systems are of limited usefulness as backrests or in hospital beds where a portion of the bed needs to be tilted at an angle to the horizontal.

Perhaps the most obvious disadvantage associated with conventional liquid displacement systems is their weight. Since substantially the entire interior of the liquid cell is filled with a liquid, its overall weight is very considerable.

It would, of course, be desirable if a liquid displacement support system could be constructed in which the above-described disadvantages would be eliminated.

I have discovered that these disadvantages, in fact, can be overcome in a system using a reduced amount of liquid, the movement of which is damped by providing a core of flexible cellular material.

It is, therefore, an object of this invention to provide a liquid displacement support system in which the movement of liquid from one point to another in the support device is damped and modulated.

It is a further object of this invention to provide a liquid displacement support system which will present a relatively stable support structure which will not exhibit the familiar undesirable flowing wave motion.

It is a further object of this invention to provide a low volume liquid displacement support system which will be considerably lighter in weight than systems heretofore known.

It is still another object of this invention to provide a liquid displacement support system in which an elongated support element can be used in a vertical position without significant bulging in its lower regions or loss of support in its upper regions.

It is another object of this invention to provide a damped liquid displacement support system which can be used as a full length mattress without the need to use any special structures under the user's head for the elimination of motion sickness.

These and other objects of the invention are accomplished by enclosing a core of resilient liquid-absorbent material within a liquid-sealed envelope, the core being saturated with a liquid. In other words, a liquid-tight envelope is provided in which the interior is substantially completely occupied by a core of resilient, liquid-absorbent material, said core being substantially saturated with a liquid.

The method used to fabricate support systems according to the present invention comprises the steps of placing a core of resilient, liquid-absorbent material within an unsealed envelope of liquid impervious material, compressing the envelope and the core so as to force substantially all gases therefrom, sealing the envelope, submerging the envelope and core in a liquid and temporarily opening the envelope while submerged to admit liquid until the core is substantially saturated.

BRIEF DESCRIPTION OF THE DRAWINGS

Referring now to FIG. 1, there is shown a damped liquid displacement support system 10 in a configuration which would be useful as a mattress. A suitable outer casing 12 is constructed of a resilient material having the properties of a good thermal insulator. Urethane foam is very suitable for this purpose. Although not shown, casing 12 may be covered with any suitable covering material generally used for mattresses so long as it is sufficiently soft and would have enough stretchability so as not to restrict the action of the invention as described below.

Figure 1:
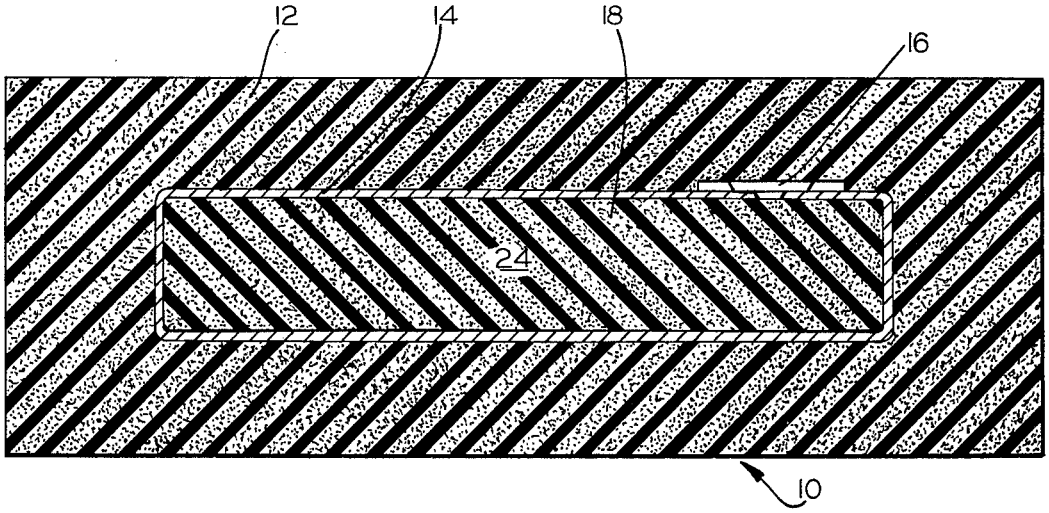
FIG. 1 is a cross-sectional view of a damped liquid displacement support system constructed in accordance with the present invention.

Within casing 12 there is shown a damped liquid displacement cell 24 comprised of a core 18 within an envelope 14. Of course, casing 12 is provided with a suitable cavity in order to accept cell 24. In practice, it may be fabricated in halves in order to facilitate the assembly of system 10. In the preferred embodiment of this invention, a suitable glue is used to adhere envelope 14 to the inner surfaces of casing 12. The glue should be of a type suitable for bonding a vinyl to foam such as Scotch-Grip Brand adhesive Number 1359 manufactured by the Three-M Company. The bonding of skin 14 to casing 12 in this manner serves to keep the cell 24 in place during its shipment or manipulation. It also aids in resisting the natural tendency of the support cell to bulge near the bottom when it is stood on end.

Envelope 14 is preferably constructed of a high quality "pool grade vinyl" with a thickness of about 0.020 inches, free of pinholes and having a cold crack resistance of at least −20 degrees Fahrenheit. This material should have properties which would permit two pieces of it to be fused together readily by using standard dielectric heating techniques.

A valve 16 is sealed in the surface of envelope 14. The valve is preferably of the positive closing type and I have found that Type 1020 AF manufactured by Halkey-Roberts is very satisfactory for this application.

Core 18 may be constructed of urethane foam or any other suitable resilient, liquid-absorbent material. Material such as urethane having a cellular structure is particularly useful because it will provide a desirable damping action as will be discussed below. Core 18 is saturated with water or another suitable liquid.

The invention is fabricated by using standard heat-sealing die tooling with a certain modification. The modification involves the packing of the die with a foam rubber or sponge material having a firmness at least twice that of the material used for core 18 for reasons mentioned below.

Figure 2:
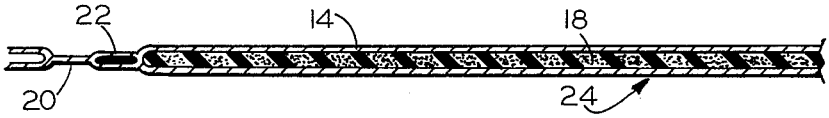
FIG. 2 is a cross-sectional view illustrating the configuration of a damped liquid displacement cell which has been compressed and sealed.

First, a piece of vinyl is placed on the bedplate of a heat sealing press so that it is centered under the die. This piece will become the bottom half of envelope 14 a damped fluid displacement cell. Next, a piece of urethane foam material would be centered on the vinyl and another piece of vinyl laid on top of the foam and again centered. The top piece of vinyl would have valve 16 fused into it and the valve would be closed. Next the heat sealing press would be actuated so that the die is brought down on the assembly. The packing in the die will compress the urethane core 18 forcing the air contained therein to be expelled. While the press is in this condition, radio frequency heating would be applied in the standard way along the intended seams 20 (FIG. 2), thereby preventing core 18 from absorbing air when the die is withdrawn. Thus, a flattened cell 24 is produced consisting of compressed core 18 in envelope 14.

Figure 3:
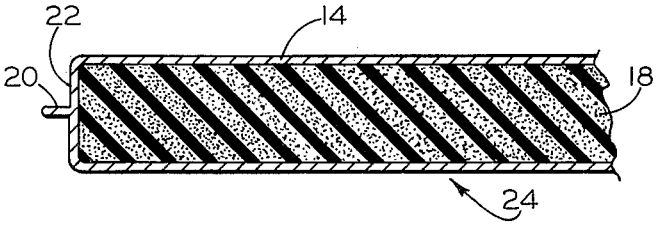
FIG. 3 illustrates the configuration of the cell shown in FIG. 2 after its core has been substantially saturated with a liquid.

Next the compressed cell is submerged in water and valve 16 is opened. Water is allowed to enter through the valve until core 18 will absorb no more. In other words, core 18 is substantially saturated. It should be noted that sufficient vinyl material 22 is provided around the edges of core 18 during the heat sealing operation in order to accommodate this expansion. This extra material 22 is shown as the vertical wall section 22 in FIG. 3. Once core 18 is saturated valve 16 is closed and the cell may be removed from the water and dried. Cell 24 is then placed within casing 12 in halves each half having a suitable cavity for the reception of cell 24. As mentioned earlier skin 14 is preferably glued to the interior surfaces of casing 12. As a final step, a suitable mattress covering may be placed around casing 12.

The operation of the invention bears some similarity to the operation of a conventional waterbed or other fluid displacement support device. The similarity involves the fact that fluid, in this case, water, is forced to migrate from one portion of the support cell 24 to another as weight is applied. However, there are vital differences in the operation of the present invention as compared with a conventional system. In the first place, the water or other liquid is not allowed to rush from the region where pressure is applied to some other region in the support cell. Rather, the movement of the water is throttled by the cellular structure of core 18. Also, the resilience of core 18 itself provides a measure of firmness in the support provided to the user. Finally, it should be considered that the amount of water available to be displaced is far less than one would find in a conventional system.

When a person uses the invention, certain pressure points are normally developed corresponding to prominent features, particularly boney protuberances, on his body. This causes the water to move away from these pressure points as core 18 is compressed under the user's weight. Since it is confined, however, the water moves upwards as well as sidewards until it conforms to the body contours and presses against a much greater area of the person's body than before. The result is that the person's body is supported with a relatively equalized pressure over a substantially larger portion of his body. This eliminates the development of any soreness at the usual pressure points where a person would normally experience it. With the present invention, this is accomplished without the undesirable rolling wave action of a conventional waterbed or water cushion. The adjustment of the system to the weight applied is relatively slow and gradual and almost imperceptible. But when a person uses the invention either as a mattress or a cushion for a few moments, he gradually feels an increasingly comfortable sense of firm support. Should he attempt to maneuver his body from one position to another or to stand, he finds that he has continuous support from the system because of its slow reaction time to his movements. This imparts a feeling of relative stability in the user as compared with the usual feeling of instability associated with conventional devices.

As noted earlier, one of the further advantages of the invention is that it can be used in relatively vertical planes without undue bulging at the bottom. This is apparently due to the fact that the interior of cell 24 is substantially evacuated prior to saturation of core 18 with water. Since there are virtually no gases remaining within cell 24, a vacuum would be formed if water migrated downwardly. Consequently, this downward migration of water is substantially prevented. This effect is enhanced by the fact that envelope 14 is glued to the interior surfaces of casing 12. If it were not, envelope 14 would merely collapse behind the migrating water as it flowed toward the bottom of a cushion standing on end. The gluing prevents this collapse, thereby taking full advantage of the vacuun effect described above.

As a further means of eliminating any wave action within an elongated support system, one might choose to use a series of individual cells rather than one long cell. Alternatively, one long cell could be provided with interior dividers for the same purpose. These arrangements are also useful in retarding the downward migration of liquid when a cell is used in a vertical position.

Clearly, various modifications could be made to the above described invention without departing from its essential spirit. For example, different substances could be chosen for the core and for the liquid medium to be contained therein. Such changes would result in variations in reaction time and the degree of firmness and stability produced by the invention. Similarily, a different casing could be provided for a support cell and this would again produce slightly different characteristics. It is intended to encompass all such modifications within the scope of the following appended claims.

I claim:

1. A damped liquid displacement support system comprised of:

an envelope of flexible material;

a core of resilient liquid-absorbent material occupying substantially all of the space within the envelope;

a liquid substantially saturating the core;

a valve mounted in the envelope for communication between its interior and its ambience for admitting and discharging liquids and gases; and an envelope provided with at least one interior divider so as to form at least two compartments therein, each compartment having its own liquid-saturated core.

2. The invention of claim 1 wherein a relatively thick casing of resilient material surrounds the envelope, and said envelope is adhesively attached to the casing.

3. A damped liquid displacement support system comprised of:

an envelope of flexible material;

a core of resilient liquid-absorbent material occupying substantially all of the space within the envelope;

a liquid substantially saturating the core;

a valve mounted in the envelope for communicating between its interior and its ambience for admitting and discharging liquids and gases; and a relatively thick casing of resilient material surrounding the envelope, said casing having a top portion lying above the core and a bottom portion lying below the core, said bottom and top portions each being substantially equal in thickness to the core itself.

4. The invention of claim 3 wherein the envelope is adhesively attached to the casing.

5. The invention of claim 4 wherein the system is a mattress.

6. The invention of claim 4 wherein the system is a cushion.

7. The invention of claim 1 or 3 wherein the system is a mattress.

8. The invention of claim 1 or 3 wherein the system is a cushion.

9. A method of fabricating a damped fluid displacement system comprising the steps of:

a. placing at least two cores of resilient liquid-absorbent material within an unsealed envelope of liquid-impervious material, said cores substantially filling the envelope;

b. inserting a divider between the cores, said divider being attached to the envelope so as to prevent any communication between the core segments;

c. compressing the envelope and the cores so as to force substantially all gases to be discharged therefrom;

d. sealing the envelope;

e. submerging the envelope and the cores in a liquid, partially opening the envelope to admit liquid until the cores will absorb no more liquid and are thus substantially saturated;

f. closing the envelope.

10. The method of claim 9 wherein a casing surrounds the envelope and including the step of: attaching the envelope to the casing.

* * * * *

UNITED STATES PATENT AND TRADEMARK OFFICE

CERTIFICATE OF CORRECTION

PATENT NO. : 4,370,768

DATED : 2/1/83

INVENTOR(S) : William S. Saloff

It is certified that error appears in the above-identified patent and that said Letters Patent is hereby corrected as shown below:

In Claim 1, column 5, line 42, the word "an" should be omitted and the word -- said -- should be inserted.

Signed and Sealed this

*Seventeenth* Day of *May 1983*

[SEAL]

*Attest:*

DONALD J. QUIGG

*Attesting Officer*

*Acting Commissioner of Patents and Trademarks*